US006378649B1

(12) United States Patent
Inoue et al.

(10) Patent No.: US 6,378,649 B1
(45) Date of Patent: Apr. 30, 2002

(54) SPEAKER MEMBER AND MANUFACTURING METHOD THEREOF

(75) Inventors: Toshihide Inoue; Yushi Ono; Takashi Onogi; Kazumasa Takemura; Hiroyasu Kumo, all of Osaka (JP)

(73) Assignee: Onkyo Corporation (JP)

( * ) Notice: Subject to any disclaimer, the term of this patent is extended or adjusted under 35 U.S.C. 154(b) by 0 days.

(21) Appl. No.: 09/517,024

(22) Filed: Mar. 2, 2000

(30) Foreign Application Priority Data

Mar. 3, 1999 (JP) ..... 11-055714
Jun. 2, 1999 (JP) ..... 11-155722
Nov. 11, 1999 (JP) ..... 11-320502

(51) Int. Cl.[7] ..... H04R 7/00

(52) U.S. Cl. ..... 181/167; 181/169; 381/426; 381/428; 428/423.7; 428/424.8

(58) Field of Search ..... 181/167, 166, 181/169–173; 381/423, 426, 428, 430, 431, 432; 428/423.1, 423.7, 424.2, 424.8, 430, 474.7

(56) References Cited

U.S. PATENT DOCUMENTS 4,140,203 A * 2/1979 Niguchi et al. ..... 181/167
4,291,781 A * 9/1981 Niguchi et al. ..... 181/169
4,308,094 A * 12/1981 Miyoshi et al. ..... 162/218
4,377,617 A * 3/1983 Ikei et al. ..... 428/214
5,744,761 A * 4/1998 Ogura et al. ..... 181/167

FOREIGN PATENT DOCUMENTS

JP 54105526 A * 8/1979 ..... 181/170
JP 58154996 A * 9/1983 ..... 181/167
JP 59061296 A * 4/1984 ..... 181/170
JP 08223685 A * 8/1996 ..... H04R/7/20

* cited by examiner

*Primary Examiner*—Paul Ip
*Assistant Examiner*—Edgardo San Martin
(74) *Attorney, Agent, or Firm*—Amin & Turocy, LLP

(57) ABSTRACT

The speaker member of the present invention comprises (a) a vibrating plate part comprising a base material, a part of the base material being impregnated with a thermosetting resin; and (b) an edge part containing the same base material as that of the vibrating plate. Such a speaker member is obtained by a method comprising the steps of: forming a base material; impregnating a portion of the base material with a thermosetting resin wherein the portion is to be a vibrating plate part; and curing said impregnated thermosetting resin so as to form the vibrating plate part, and simultaneously forming an edge part.

21 Claims, 6 Drawing Sheets

SPEAKER MEMBER AND MANUFACTURING METHOD THEREOF

BACKGROUND OF THE INVENTION

1. Field of the Invention

The present invention relates to a speaker member having a vibrating plate part and an edge part. More specifically, the invention relates to a speaker member in which the vibrating plate part and edge part include the same material and both the vibrating plate part and the edge part satisfy the required characteristics.

2. Description of the Related Art

Generally, a vibrating plate and an edge of a speaker member are, made of different materials respectively. This is because the performances required for the vibrating plate and that required for the edge are quite different from each other. The vibrating plate pushes air around it to generate compressional wave, thereby generate acoustic wave. Therefore the vibrating plate is required to have enough strength to withstand the pressure of air. On the other hand, the edge is required to have enough flexibility to follow the movement of the vibrating plate as well as adequate vibration absorbing characteristics where the acoustic waves transmitted through the vibrating plate can be absorbed to the edge without reflection. In this way, performances required for the vibrating plate and the edge are different from each other. Therefore, in the process for preparing conventional speakers, the vibrating plate and the edge are made of different materials and the resultant two parts are adhered together in order to satisfy the respective requirements. Thus, in the process for manufacturing conventional speakers, material costs are required, respectively, for the vibrating plate and the edge; and preparing processes for each of the two parts and also, adhering process are required. The manufacture of conventional speakers are thus extremely high in cost and low in manufacturing efficiency.

In order to solve such problems, a method is proposed wherein the vibrating plate part and the edge are formed simultaneously, during the process of making a pulp cone. However, in this method, a special resin layer must be formed on the edge in order to prevent passage of air through the edge and to restrain the reflection of the vibrating plate. In this way, the manufacture of such a speaker has a large number of processes and is troublesome. The resultant edge, which vibrates in accordance with the vibration of the vibrating plate, is inadequate in durability and waterproof property since a pulp fiber, which is the core material of the edge, is low in strength. Moreover, the flexibility of the edge is inadequate because the resin layer is provided.

Another method is proposed, in which the vibrating plate and the edge are formed simultaneously by two-color injection molding. However in this method, resin materials that can be used are limited to thermoplastic resins. Therefore, the resultant speaker member is inadequate in heat resistance and elastic modulus.

Furthermore, a method has been proposed, in which a resin film or metal foil is formed into a shape of a cone- or dome-shaped vibrating plate, and the film or the foil is also formed into a roll-shaped edge. However, in this method, no measures are taken for satisfying the above-mentioned conflicting requirements for the vibrating plate and edge, and thus the strength of the edge is the same as the strength of the vibrating plate. An adequate amplitude of vibration, therefore, cannot be obtained. Furthermore, since the edge has hardly any vibration absorbing characteristics, a speaker for practical use cannot be obtained.

Among flat speakers, there are speakers containing a member that do not have an edge. However, flat speakers containing a member that has an edge is generally used. This member is obtained, as in the process for preparing a speaker having a cone shaped vibrating plate, by adhering a vibrating plate together with an edge, the vibrating plate and the edge being made of different material from each other. Furthermore, conventional flat vibrating plates use foamed polystyrene materials in order to obtain high strength, greater thickness, and lighter weight. In such a flat vibrating plate, the internal loss is small, therefore, break up vibration occurs readily. As a result, a peak-dip difference in vibration characteristics (vertical fluctuation of the sound pressure level in vibration—sound pressure carve) becomes large. Although flat vibrating plates made of aluminum honeycomb are also used, such a flat vibrating plate is also small in internal loss and thus large in the peak-dip difference and, therefore, generates a distinctive, peculiar sound.

Though attempts have thus been made to form the vibrating plate and the edge simultaneously, a speaker member with which the respective requirements of the vibrating plate and the edge are satisfied have not been obtained.

A speaker member in which a vibrating plate part and an edge part are formed readily and in which both the vibrating plate part and the edge part are excellent in the required performance is thus strongly desired.

SUMMARY OF THE INVENTION

The present invention relates to a speaker member comprising:

(a) a vibrating plate part comprising a base material, a part of the base material being impregnated with a thermosetting resin; and (b) an edge part containing the same base material as that of the vibrating plate.

In a preferred embodiment, said base material is a laminated body having at least two non-woven fabric layers and a resin film layer disposed between said non-woven fabric layers.

In a preferred embodiment, said non-woven fabric layer includes a non-woven fabric layer made of para-aramid fiber, meta-aramid fiber, rayon fiber, cotton fiber, ultra-high strength polyethylene fiber, or polyarylate fiber.

In a preferred embodiment, said resin film layer is comprised of a thermoplastic elastomer.

In a preferred embodiment, said thermoplastic elastomer is selected from the group consisting of urethane elastomers, amide elastomers, olefin elastomers, styrene elastomers, polyester elastomers, and ethylene/vinyl acetate elastomers.

In another preferred embodiment, said base material is a laminated body having at least two first non-woven fabric layers and a second non-woven fabric layer disposed between said non-woven fabric layers.

In a more preferred embodiment, said second non-woven fabric layer is made of thermoplastic elastomer fiber.

In a preferred embodiment, said thermoplastic elastomer fiber is selected from the group consisting of urethane elastomer fibers, amide elastomer fibers, olefin elastomer fibers, styrene elastomer fibers, polyester elastomer fibers, and ethylene/vinyl acetate elastomer fibers.

In a preferred embodiment, said base material is a laminated body having at least two non-woven fabric layers and an elastic woven fabric layer disposed between said non-woven fabric layers.

In a preferred embodiment, said elastic woven fabric layer is made of saturated polyester fiber.

In more preferred embodiment, said saturated polyester fiber is a poly(trimethyleneterephthalate) fiber.

In yet another preferred embodiment, said base material is a non-woven fabric made of thermoplastic elastomer fiber.

In a preferred embodiment, said base material is a woven fabric.

In a more preferred embodiment, said woven fabric base material is an elastic woven fabric made of saturated polyester fiber.

In a preferred embodiment, said saturated polyester fiber is a poly(trimethyleneterephthalate) fiber.

In a preferred embodiment, said thermosetting resin is a unsaturated polyester resin.

In a preferred embodiment, said thermosetting resin further contains short fibers of a natural fiber, a regenerated fiber or a synthetic fiber, or a mixture thereof.

In a preferred embodiment, said edge part contains a base material impregnated with a photocurable resin.

In more preferred embodiment, said photocurable resin is an acrylic resin.

In a preferred embodiment, said edge part contains a thermosetting resin that is different from the thermosetting resin in said vibrating plate part.

In yet another preferred embodiment, the thermosetting resin contained in the edge part further contains short fibers of a natural fiber, a regenerated fiber or a synthetic fiber, or a mixture thereof.

In more preferred embodiment, said thermosetting resin contained in the edge part is a thermosetting polyether urea elastomer.

In a preferred embodiment, said vibrating plate part has a cone shape.

In yet another preferred embodiment, said vibrating plate part has a flat shape.

In a preferred embodiment, said vibrating plate part has a reinforcing part.

The present invention also relates to a method of manufacturing a speaker member comprising the steps of:

forming a base material, impregnating a portion of the base material with a thermosetting resin wherein the portion is to be a vibrating plate part, and curing said impregnated thermosetting resin so as to form the vibrating plate part, and simultaneously forming an edge part.

In a preferred embodiment, said base material is a laminated body having two non-woven fabric layers and a resin film layer disposed between the non-woven fabric layers, and wherein said impregnated thermosetting resin is cured to form the vibrating plate part, and said resin film layer is simultaneously melted and solidified to form the edge part.

In a preferred embodiment, said base material is a laminated body having at least two first non-woven fabric layers and a second non-woven fabric layer disposed between said first non-woven fabric layers, and wherein the vibrating plate part is formed by curing said impregnated thermosetting resin and the edge part is simultaneously formed by melting and solidifying said second non-woven fabric layer.

In a preferred embodiment, said base material is a laminated body having at least two non-woven fabric layers and an elastic woven fabric layer disposed between said non-woven fabric layers, and wherein the vibrating plate part is formed by curing said impregnated thermosetting resin and the edge part is simultaneously formed by melting and solidifying said elastic woven fabric layer.

In yet another preferred embodiment, said base material is a non-woven fabric layer made of elastomer fiber, and wherein the vibrating plate part is formed by curing said impregnated thermosetting resin and the edge part is simultaneously formed by melting and solidifying said base material.

In a preferred embodiment, said base material is an elastic woven fabric layer made of saturated polyester fiber, and wherein the vibrating plate part is formed by curing said impregnated thermosetting resin and the edge part is simultaneously formed by melting and solidifying said base material.

The present invention further related to a method for manufacturing a speaker member comprising the steps of:

forming a base material, impregnating a portion of said base material with a thermosetting resin, wherein the portion is to be a vibrating plate part, impregnating a portion of said base material with a photocurable resin, wherein the portion is to be the edge part, forming the vibrating plate part by curing said impregnated thermosetting resin, and forming the edge part by curing said impregnated photocurable resin.

The present invention also relates to a method for manufacturing a speaker member comprising the steps of:

forming a base material, impregnating a portion of said base material with a first thermosetting resin, wherein the portion is to be the vibrating plate part, impregnating a portion of said base material with a second thermosetting resin, wherein the portion is to be the edge part, and curing said impregnated first and second thermosetting serins, resulting in a simultaneous formation of the vibrating plate part at the edge part.

BRIEF DESCRIPTION OF THE DRAWINGS

FIG. 3 is a figure showing a flat speaker member according to the preferred embodiment of the present invention.

DESCRIPTION OF THE PREFERRED EMBODIMENT

Figure 1:
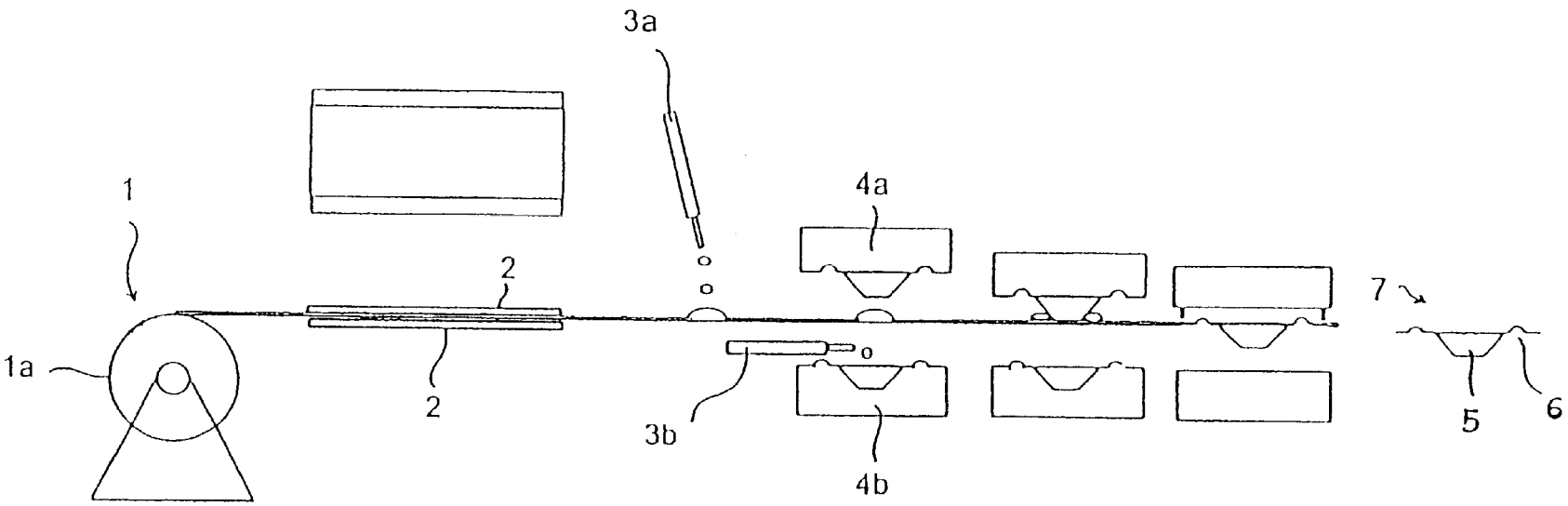
FIG. 1 is a schematic view for explaining a manufacturing method of a speaker member according to the preferred embodiment of the present invention.

The present inventors found that a speaker member having a vibrating plate part and an edge part, each parts satisfying required characteristics, can be obtained by forming the vibrating plate part and the edge part using the same material, and thus, accomplished the present invention.

First Embodiment

The speaker member of this invention has a vibrating plate part and an edge part. The speaker member of this invention has the functions of a vibrating plate and the functions of an edge part in a single body. A suitable and arbitrary shape (such as a cone shape, dome shape, or flat shape) may be adopted (a cone shape is used most widely) as the shape of the vibrating plate portion. In the present embodiment, an explanation will be given without any particular restriction to the shape of the vibrating plate part.

The vibrating plate part comprises a base material, and a part of the base material is impregnated with a thermosetting resin. The base material may be a woven fabric or a non-woven fabric.

A non-woven fabric base material may be a single non-woven fabric or a laminated body having a plurality of non-woven fabric layers.

The non-woven fabric (layer) is made of suitable and arbitrary short fibers. Typical examples of such short fibers include para-aramid fibers, meta-aramid fibers, rayon fibers, cotton fibers, ultra-high strength polyethylene fibers, and polyarylate fibers. Para-aramid fibers are preferable for he reasons of large internal loss and excellent strength of the fiber. The fiber length of the short fibers may be defermined according to the end purpose, but the typical length is 30 to 60 mm. The non-woven fabric (layer) can be made of a single kind of short fiber or a combination of two or more kind of short fibers.

Preferably, the non-woven fabric base material is a laminated body having at least two non-woven fabric layers and a resin film layer disposed between the non-woven fabric layers. The resin film layer is melted and solidified in the forming process, thereby an edge part is easily formed. Furthermore, the resultant edge part contains the above-mentioned solidified resin film, and therefore the passage of air through the edge part will be prevented satisfactorily. Typically, the laminated body has two non-woven fabric layers and a resin film layer disposed between the non-woven fabric layers. The non-woven fabric layers of a laminated body may both be made of the same fiber material (short fibers) or may be made of different fiber materials, respectively.

The above-mentioned resin film layer is preferably made of a suitable and arbitrary thermoplastic elastomer. Typical examples of thermoplastic elastomers include urethane elastomers, amide elastomers, olefin elastomers, styrene elastomers, polyester elastomers, and ethylene/vinyl acetate elastomers.

Due to reasons of high internal loss, urethane elastomers are preferable. The thermoplastic elastomer is formed into a film by a suitable and arbitrary process, and then used as the resin film layer. Although the thickness of the resin film layer may be determined according to the end purpose, the thickness is 0.03 to 0.10 mm in typical cases.

Particularly suitable arrangements of the laminated body include para-aramid fiber/urethane elastomer/para-aramid fiber, para-aramid fiber/urethane elastomer/rayon fiber, para-aramid fiber/urethane elastomer/cotton fiber, meta-aramid fiber/urethane elastomer/meta-aramid fiber, para-aramid fiber/olefin elastomer/para-aramid fiber, para-aramid fiber/styrene elastomer/para-aramid fiber, para-aramid fiber/amide elastomer/para-aramid fiber, and para-aramid fiber/polyester elastomer/para-aramid fiber. An especially favorable arrangement of the laminated body is the para-aramid fiber/urethane elastomer/cotton fiber arrangement.

In another embodiment, the non-woven fabric base material is a laminated body having at least two first non-woven fabric layers and a second non-woven fabric layer disposed between the aforementioned non-woven fabric layer. The use of first and second non-woven fabric layers provides the following effect. In the process of impregnating the laminated body with a thermosetting resin, application of the thermosetting resin on one surface of the laminated body makes satisfactory soaking of the resin into an entire portion of the laminated body (i.e., base material) that is to be the vibrating plate. As a result, the elastic modulus of the resultant vibrating plate part further improves. Furthermore, when the laminated body is heat-molded, the second non-woven fabric layer is melted and solidified. Therefore the prevention of the passage of air through the resultant edge portion can be performed and maintained satisfactorily.

Typically, the material of the first non-woven fabric layer is the same as that of the above-described non-woven fabric base material. The second non-woven fabric layer is preferably a non-woven fabric that is made of a thermoplastic elastomer fiber (herein after, referred to as non-woven elastomer fabric) The non-woven elastomer fabric refers to a non-woven fabric in which thermoplastic elastomer fibers are tangled in a random manner, and a portion of the fibers may be melted. Typical examples of thermoplastic elastomer fiber include polyurethane elastomer fibers, polyamide elastomer fibers, polystyrene elastomer fibers, polyamide elastomer fibers, polyester elastomer fibers, and ethylene/vinyl acetate elastomer fibers. Urethane elastomer fibers are preferable because a speaker member with large internal loss can be obtained. Since non-woven elastomer fabrics are readily impregnated with a thermosetting resin, a speaker member with excellent elastic modulus can be obtained. Furthermore, since non-woven elastomer fabric contain a number of voids (portions of air) in its interior, the thickness per unit area will be large, and as a result, a speaker member of excellent rigidity can be obtained. The second non-woven fabric layer is formed from a thermoplastic elastomer using a suitable and arbitrary method.

Alternatively, the non-woven fabric base material may be a single non-woven elastomer fabric.

In yet another embodiment of the present invention, the above-mentioned non-woven fabric base material is a laminated body having non-woven fabric layers and an elastic woven fabric layer disposed between the non-woven fabric layers. The elastic woven fabric refers to a woven fabric with elasticity (that is, a woven fabric that can stretch and shrink). The elastic woven fabric is formed by a suitable and arbitrary method. The non-woven fabric layer can be the same as that described above. By using an elastic woven fabric layer, the internal loss of the edge part can be improved while maintaining the elastic modulus of the vibrating plate part. Furthermore, since the elastic woven fabric is melted and solidified in the process of forming the speaker member, the prevention of the passage of air through the resultant edge part is maintained satisfactorily.

Preferably, the above-described elastic woven fabric layer is made of saturated polyester fiber. Poly (trimethyleneterephthalate) fiber is especially suitable as the saturated polyester fiber. This is because poly (trimethyleneterephthalate) fiber has high elasticity, large internal loss, and also has excellent flexibility.

Alternatively, the base material can be a single woven fabric. As mentioned above, the woven fabric base material is preferably an elastic woven fabric made of saturated polyester fiber. More preferably, the woven fabric base material is made of poly(trimethyleneterephthalate) fiber. Since poly(trimethyleneterephthalate) has extremely large internal loss, a speaker member with extremely large internal loss can be obtained.

The above-described non-woven fabric base material, laminated body base material, non-woven elastomer base material, or woven fabric base material can be selected suitably according to the end purpose.

Although a suitable and arbitrary thermosetting resin can be used as the thermosetting resin to be impregnated into the base material, a unsaturated polyester resin is preferably used because it can be cured in the shortest time period. In the present invention, an arbitrary and suitable unsaturated polyester resin is used. Various types of thermosetting resin (for example, unsaturated polyester resin) are commercially available in the form of a liquid composition.

Preferably, such a thermosetting resin composition further contains short fibers of a natural fiber, regenerated fiber, or synthetic fiber or a mixture of such fibers (hereinafter referred to as auxiliary fibers). The auxiliary fiberss have a fiber length of preferably 20 mm or less and more preferably 5 mm or less (for practical use, the shortest fiber length is 1 mm). The shorter the fiber length is, the more readily the auxiliary fibers are dispersed in the thermosetting resin, and thus the impregnation of the base material with the resin and the auxiliary fibers is excellent. Considering the contribution of longer fibers to the improvement of the elastic modulus, and further considering the balance between the dispensability of the auxiliary fibers (also, impregnation of the base material with the resin) and the elastic modulus of the resultant speaker member, a shorter fiber length is preferable for the auxiliary fibers.

Typical examples of natural fibers include cotton and hemp. Typical examples of regenerated fibers include rayon and polynosic fibers. Typical examples of synthetic fibers include fibers made of nylon, vinylon, aramids, carbon, polyarylates, and aromatic compounds containing heterocyclic groups. High elasticity fibers, such as fibers made of aramids, carbon, polyarylates, and aromatic compounds containing heterocyclic groups are preferable. This is because a speaker member of excellent elastic modulus can then be obtained.

Preferably, the above-described auxiliary fibers can be added in an amount of 5 to 30 parts by weight, and more preferably, 10 to 15 parts by weight per 100 ports by weight of the thermosetting resin. When the auxiliary fibers are added to the thermosetting resin in the above range, the impregnation properties and the elastic modulus of the resultant speaker member will both be excellent.

The edge part contains the same base material as that of the above-described vibrating plate part.

Preferably, a portion of the above-mentioned base material which is to be an edge part is impregnated with a photocurable resin. Although any suitable photocurable resin can be used, acrylic resin may be given as a typical example.

Alternatively, a portion of the base material which is to be an edge part can be impregnated with a thermosetting resin that is different from the thermosetting resin contained is the above-described vibrating plate part. By including a thermosetting resin in the edge part, the heat resistance of the edge part is significantly improved. A thermosetting polyether urea elastomers can be used favorably as such a thermosetting resin. Since polyether urea elastomers are extremely flexible, the heat resistance of the resultant edge part is improved, and furthermore, a speaker member including the resultant edge part can realize acoustic wave with great amplitude. As a result, a speaker member with adequate performance for full-range use can be obtained. Such a polyether urea elastomer has, for example, the following characteristics: rubber hardness of 73, tensile strength of 298 kg/cm$^2$, elongation rupture of 425%, and melting point of 200° C. or more.

In the following, the method for forming the base material will be explained, and then, the method for manufacture of a speaker member of a preferred embodiment of the present invention will be described with reference to the drawings.

(Base Material Forming Method)

For example, when the base material is a single non-woven fabric, the non-woven fabric is made of the above-described short fibers using a suitable and arbitrary method. Typical examples of methods for forming the non-woven fabric include the fluid entanglement method which employs a liquid such as water, or a gas such as air; and a method in which short fibers are mechanically entangled in a random manner. The fluid entanglement method is preferable in that non-woven fabric of low anisotropy of elastic modulus and good forming properties can be obtained. For example, a non-woven fabric can be obtained by randomly orienting the above-described fibers in an air stream by the dry method to form an accumulated fiber layer and then entangling the fibers in the layer by the water stream entanglement method. Although the weight per unit area of the non-woven cloth may differ according to the end purpose, it is 30 to 150 g/m$^2$ in typical cases. When the base material is, for example, a laminated body having two non-woven fabric layers and a resin film layer disposed between the non-woven fabric layers, the non-woven fabric layers and the resin film layer may be formed, respectively, using a suitable and arbitrary method, and then layered together by a suitable and arbitrary method. A base material made of a non-woven elastomer fabric or a woven fabric base material may also be prepared using a suitable and arbitrary method.

(Speaker member manufacturing method)

In the following, the speaker manufacturing method for the case where the base material is a single non-woven fabric will be described with reference to FIG. 1 (those skilled in the art can recognize that the present process can be applied likewise to other various types of base materials). As shown in FIG. 1, a non-woven fabric base material 1*a* is provided in the form of a roll in a feeding device 1 and is fed out from feeding device 1 in accordance with the running of this system. In order to prevent deformation of the non-woven fabric base material 1*a*, the sides (with respect to the feeding direction) of the feeding base material are movably supported by clamps 2.

Next, the thermosetting resin is fed from resin feeding nozzle 3*a* onto a specific portion of non-woven fabric base material 1*a*, from which the vibrating plate part is to be formed. Then, a thermosetting resin is also fed from resin supply nozzle 3*b* onto lower die 4*b* corresponding to the vibrating plate part. Although the thermosetting resin may be fed onto one side of non-woven fabric 1*a*, the resin is preferably fed onto the upper side and a lower portion of non-woven fabric base material 1*a* as shown in FIG. 1. By the application of the thermosetting resin from both sides of the base material, the thermosetting resin can be prevented from being unevenly present at one side of the resultant vibrating plate part. This phenomenon is especially significant in the case where the non-woven fabric base material is a laminated body having a resin film layer or an elastic woven fabric layer. In the case where the non-woven fabric base material is a laminated body having a non-woven elastomer fabric layer, the thermosetting resin can be preferably impregnated into the entire area where the vibrating plate part will be formed by the application of the thermosetting resin onto one side of non-woven fabric 1*a*. The thermosetting resin does not unevenly present on one side of the base material.

Next, the non-woven fabric la where the thermosetting resin has been applied is hot pressed using upper die 4*a* and lower die 4*b*, each of which has an integrated shape of a vibrating plate part and an edge part. In accordance with press-molding, the thermosetting resin is impregnated into and cured at a portion of non-woven fabric base material 1*a* where the vibrating plate is to be formed. In this way, vibrating plate part 5 is formed, and the edge part 6 is formed simultaneously by the melting and solidification of the base material. In the case where a laminated body having a resin film layer is used as non-woven fabric base material 1*a*, the resin film layer is melted by the hot pressing and then solidifies to form the edge part 6. In the final stage, the base material is released from the dies and the periphery of the base material is removed to obtain speaker member 7.

As for the conditions for hot pressing (for example, the die temperature, die pressure, pressing time, and die clearance), suitable and arbitrary conditions may be adopted according to the end purpose or type of non-woven fabric base material employed. In a typical case, the die temperature is 100 to 130° C., the heating time is 0.5 to 3 minutes, the pressure during pressing is 15 to 25 kg/cm$^2$, and the die clearance (which corresponds to the thickness of the speaker member to be obtained) is 0.1 to 0.3 mm.

Figure 2:
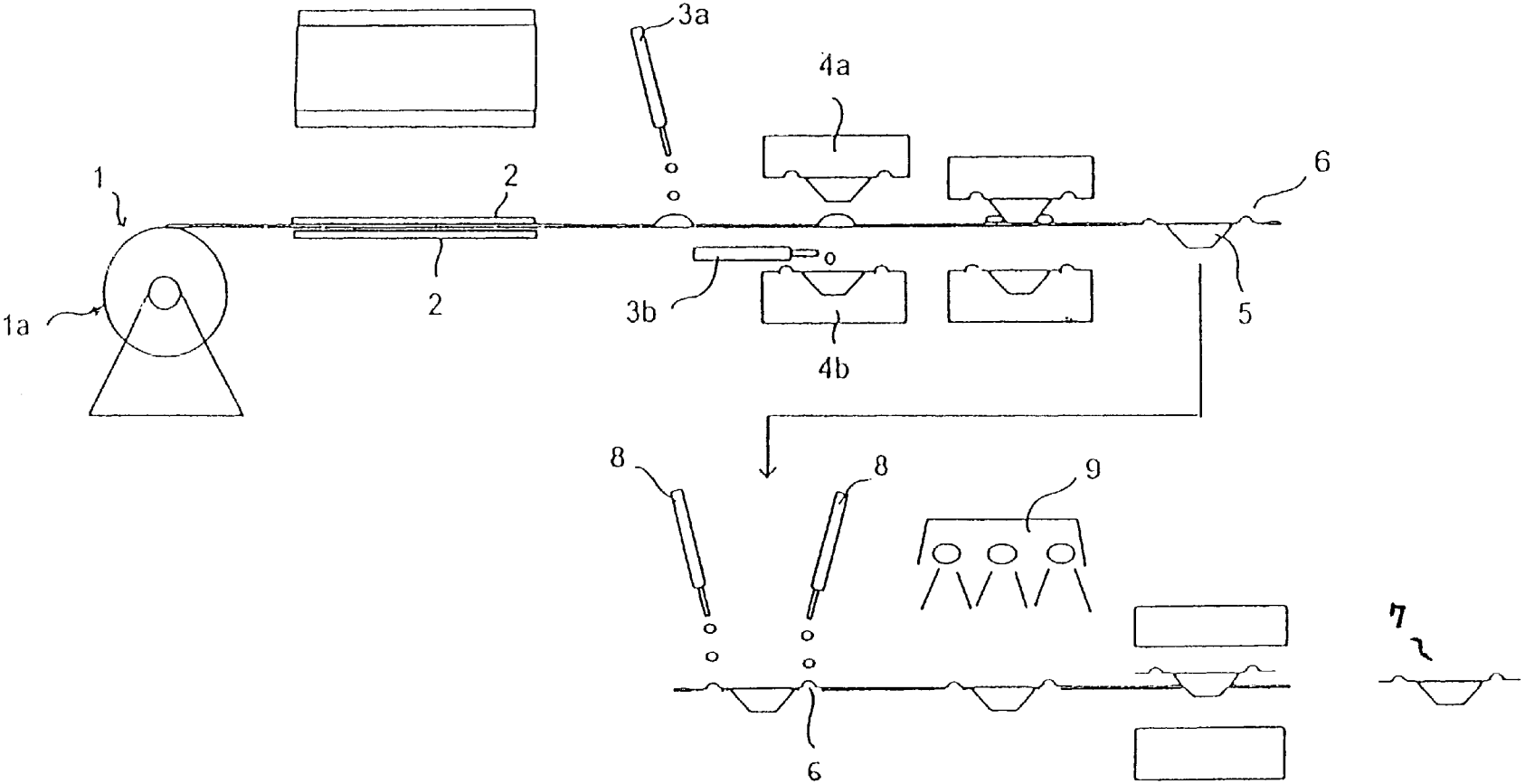
FIG. 2 is a schematic view for explaining a manufacturing method of a speaker member according to another preferred embodiment of the present invention.

Next, the speaker member manufacturing method for another embodiment of the present invention shall be described by way of FIG. 2. For the sake of simplicity, only the processes characteristic to this embodiment will be described (unless indicated otherwise, the procedures described with reference to FIG. 1 can be employed).

A thermosetting resin is supplied to both sides of a non-woven fabric base material la using resin feeding nozzles 3*a* and 3*b*, and hot pressing is performed using an upper die 4*a* and a lower die 4*b*, edge of which has an integrated shape of a vibrating plate part and an edge part. The thermosetting resin is impregnated into and cured at a portion of the base material where the vibrating plate is to be formed. In this way, vibrating plate part 5 is formed, and the edge part 6 is preformed. A photocurable resin is then applied onto the preformed edge part 6 from a resin feeding nozzle 8. This preformed edge part 6 is irradiated with ultraviolet rays using a suitable and arbitrary ultraviolet ray irradiation lamp (for example, a mercury lamp) 9 in order to cure the photocurable resin. As the ultraviolet ray irradiation conditions, suitable and arbitrary conditions may be employed according to the kind of photocurable resin employed. In the case where the photocurable resin is an acrylic resin, irradiation is performed at an irradiation density of 600 to 900 mW/cm$^2$ for 30 to 60 seconds in typical cases.

In this way, an edge part with desired characteristics can be formed. In the final stage, the resultant base material is released from the dies and the periphery of the base material is removed to obtain speaker member 7.

The speaker member manufacturing method for another embodiment of the present invention will now be described briefly. A predetermined thermosetting resin (for example, an unsaturated polyester) is fed from a resin feeding nozzle onto the portion of the non-woven fabric base material where the portion is to be a vibrating plate part, and a different kind of thermosetting resin (for example, a thermosetting polyether urea elastomer) is fed from another resin feeding nozzle onto a lower die corresponding to the edge part. Next, this non-woven fabric base material is hot pressed using an upper die and a lower die, each of which has an integrated shape of a vibrating plate part and an edge part. The above-mentioned two kinds of thermosetting resin are impregnated into the base material and cured, respectively, so that the vibrating plate part and the edge part are formed simultaneously.

Second Embodiment

A speaker member having a flat vibrating plate part and an edge part will now be described as another embodiment of the present invention. Only the portions characteristic to the flat speaker member shall be described below with reference to FIG. 3A to FIG. 3D.

Figure 3A:
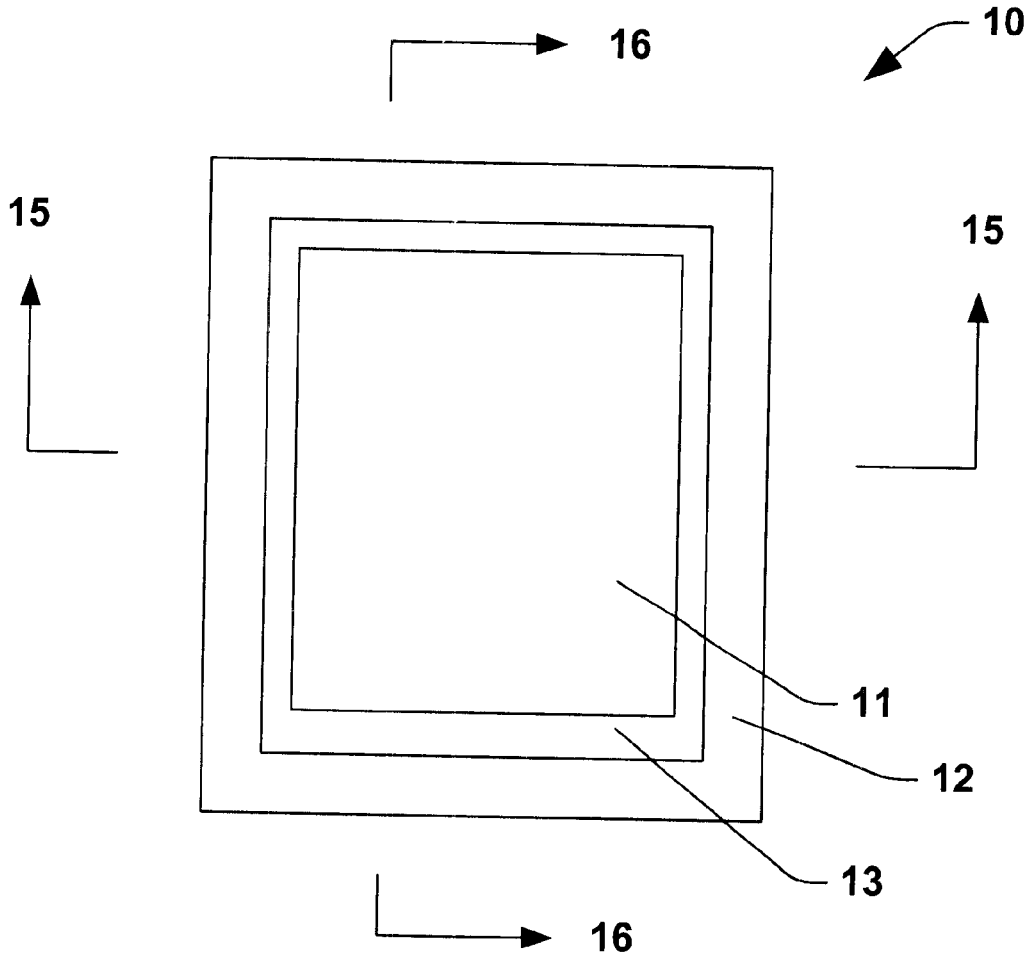
FIG. 3A is a plan view of the speaker member.
Figure 3B:
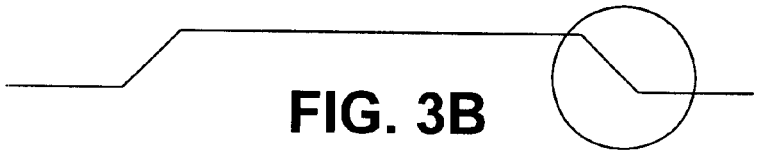
FIG. 3B is a sectional view along line 15 of the speaker member of FIG. 3A.
Figure 3C:
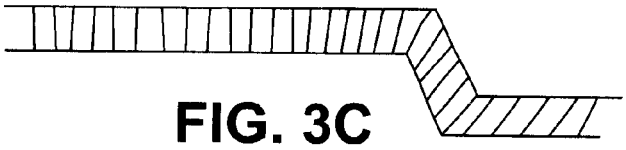
FIG. 3C is an enlarged view of the portion of FIG. 3B surrounded by a circle.
Figure 3D:
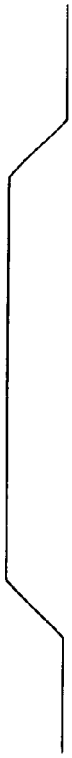
FIG. 3D is a sectional view along line 16 of the speaker member of FIG. 3A.

FIG. 3 is a schematic view for explaining the flat speaker member of a preferred embodiment of the present invention, and FIG. 3A is a plan view. FIG. 3B is a sectional view along line 15 of the speaker member of FIG. 3A. FIG. 3D is a sectional view along line 16 of the speaker member of FIG. 3A. FIG. 3C is an enlarged view of the portion of FIG. 3B surrounded by an ellipse. Flat speaker member 10 has a flat vibrating plate part 11 and an edge part 12. Preferably, flat vibrating plate part 11 has a reinforcing part 13. Reinforcing part 13 is provided to maintain the strength of flat vibrating plate part 11. Reinforcing part 13 is made of the same material as that of flat vibrating plate 11. Reinforcing part 13 has a suitable and arbitrary shape and is formed at a suitable and arbitrary portion of flat vibrating plate part 11. As shown in FIG. 3C, reinforcing part 13 is formed on the outer peripheral part of flat vibrating plate part 11 in a typical case. In more detail, reinforcing part 13 is formed by bending the outer peripheral part of flat vibrating plate part 11. Edge part 12 is formed so as to extend from the edge parts of vibrating plate part 11 and reinforcing part 13.

The speaker member of this embodiment can also be manufactured using the similar method as that of the first embodiment. The speaker member of the present embodiment can be obtained using dies, each of wide having an integrated shape of a vibrating plate part and an edge part in the manufacturing process. Furthermore, in the case where the flat vibrating plate part has a reinforcing part, dies each of which having an integrated shape of an edge part and a flat vibrating plate part including a reinforcing part can be used.

The effects of the present invention will now be described.

In the present invention, since the same base material is used for the vibrating plate part and the edge part, the conventional process of adhering the vibrating plate part together with the edge part is not required. The disadvantages of the prior art, that is, inadequate durability and inadequate water resistance property of the adhered portion can thus be resolved. Actuality, the speaker member of the present invention has adequate durability and water resistance property for practical use as a car speaker, where excellent durability and water resistant property are required. Also, is the present invention, since a prescribed thermosetting resin is selectively impregnated into only the vibrating plate part, satisfactory characteristics can be obtained for both the vibrating plate part and the edge part, in which the required characteristics are quite different from each other. In this way, the vibrating plate part of the speaker member of the present invention has excellent strength, whereas, the edge part has excellent flexibility and large internal loss. Furthermore, since the speaker member of the present invention uses a thermosetting resin, it is also excellent in heat resistance.

The base material may be a woven fabric or a non-woven fabric. In a preferred embodiment, the base material is made of a non-woven elastomer fabric. In another preferred embodiment, the base material is made of an elastic woven fabric. Since both of these base materials are readily impregnated with thermosetting resin, a speaker member with excellent elastic modulus can be obtained. Furthermore, since these base materials contain numerous voids (portions of air) in their interior, the thickness per unit area is large. As a result, an edge part with excellent rigidity (that is, ability to support the vibrating plate) can be obtained. Furthermore, in cases where these base materials are used, since the materials themselves have excellent elastic modulus and large internal loss, a speaker member with excellent elastic modulus and large internal loss can be obtained.

In another preferred embodiment, the above-described base material is a laminated body having non-woven fabric layers and a resin film layer disposed between the non-woven fabric layers. When such a laminated body is used, the resin film layer melts and solidifies in the speaker member forming process. Therefore the edge part can be formed easy. Furthermore, since the edge part of the resultant speaker member contains a solidified resin film, the passage of air through the edge part is prevented extremely well.

In yet another embodiment of the present invention, the above-described non-woven fabric base material is a laminated body having two first non-woven fabric layers and a second non-woven fabric layer (for example, a non-woven elastomer fabric layer) disposed between the first non-woven fabric layers. By using a laminated body having a second non-woven fabric layer, a thermosetting resin can be impregnated into the entire portion of the laminated body that is to be the vibrating plate part when the thermosetting resin is applied onto one side of the non-woven fabric. Therefore the elastic modulus of the resultant vibrating plate can further improved. Moreover, the prevention of the passage of air through the resultant edge part can be performed and maintained satisfactorily.

In yet another embodiment of the present invention, the above-described non-woven fabric base material is a laminated body having non-woven fabric layers and an elastic woven fabric layer disposed between the non-woven fabric layers. By using an elastic woven fabric layer, the internal loss of the edge part can be improved while maintaining the elastic modulus of the vibrating plate part. Moreover, a condition where the passage of air through the edge part is prevented satisfactorily will be maintained.

These base materials may be suitably selected and used according to the end purpose.

In a preferred embodiment, the edge part contains a thermosetting resin which is different from the thermosetting resin contained in the vibrating plate part. Since the edge part contains a thermosetting resin, the heat resistance of the edge part is improved significantly. Furthermore, by the use of an extremely flexible thermosetting resin, such as a polyether urea elastomer, the resultant edge part has an excellent heat resistance and a speaker member including the resultant edge part can realize acoustic wave with great amplitude. As a result, a speaker member can be obtained that exhibits adequate performance for full-range use.

The present invention also provides a flat speaker member. In this flat speaker member, the same non-woven fabric base material is used in both the flat vibrating plate part and the edge part and the flat vibrating plate part selectively contains a thermosetting resin. Therefore, the flat vibrating plate part has excellent strength and the edge part has large internal loss. In a preferred embodiment, the above-described flat speaker member has at least two non-woven fabric layers and any one of a resin film layer, a non-woven elastomer fabric layer, and an elastic woven fabric layer disposed between the non-woven fabric layers. Accordingly, the flat vibrating plate part has even better strength and higher internal loss. Therefore, the disadvantage of the conventional flat vibrating plate employing a foamed polystyrene, in that the strength of the vibrating plate cannot be maintained when the vibrating plate is made thin, can thus be resolved. Accordingly, a very thin vibrating plate can be obtained. In fact, a flat speaker member of the present invention can withstand vibration even when the thickness of the member is approximately 0.2 mm. Furthermore, the flat speaker member of the present invention has high internal loss. As a result, break up vibration, which a problem is a conventional flat vibrating plates that employs a foamed polystyrene material or an aluminum honeycomb, is prevented satisfactorily. Therefore the peak-dip difference can be reduced. The peculiar, characteristic sound that is generated by conventional flat speakers can thus be prevented. Furthermore, in the flat speaker of the present invention, since the flat vibrating plate part and the edge part are formed integrally, the problem of inadequate durability at adhered portions can be solved.

The flat vibrating plate part preferably has a reinforcing part. The reinforcing part is provided to maintain the strength of the flat vibrating plate part. By providing the flat vibrating plate part with a reinforcing part, the strength is improved further and the occurrence of break up vibration and the peak-dip difference can be reduced further.

Also in the manufacturing method of the present invention, since the vibrating plate part and the edge part are formed from the same base material, the material loss and the number of manufacturing processes are decreased significantly. As a result, the manufacturing method of the present invention accomplishes low cost and excellent manufacturing efficiency.

The present invention will be described more specifically by way of examples. The present invention, however, is not limited to these examples. Unless indicated otherwise, the parts and percentages indicated in the description of the examples are based on weight.

A. Speaker member formed integrally from a laminated body comprised of a base material of non-woven fabric/resin film/non-woven fabric

EXAMPLE 1

A solution of the following composition containing unsaturated polyester was prepared:

Unsaturated polyester resin (N350L; made by Nippon Shokubai Co., Ltd.): 100 (parts)

Mica (Clarite Mica 600W; made by Kuraray Co., Ltd.): 30

Low shrink agent (Modiper S501; made by NOF corporation): 5

Per-octa O (made by NOF corporation): 3

Meanwhile, short fibers of a para-aramid fiber (Technola; made by Teijin Ltd.; fiber length: 38 mm) were oriented randomly in an air stream by the dry method to prepare an accumulated layer, and the fibers were mechanically entangled with each other by the water stream entanglement method to prepare a non-woven fabric of a weight of 35 g/m$^2$. Using two sheets of the thus-obtained non-woven fabric, a laminated body having a polyurethane elastomer film (Elastolan NY Type; made by Takeda Badesch Urethane Industry Co., Ltd.; thickness: 0.05 mm) disposed between the non-woven fabric sheets was prepared.

The above-described solution containing unsaturated polyester was selectively applied at a density of approximately 125 to 150 g/m$^2$ onto the central part (in other words, the portion is to be the vibrating plate) of the laminated body. Using matched die having shapes of a vibrating plate part with an integral edge part, hot pressing at 130°C. was performed for 1 minute to obtain a cone type speaker with which the diameter of the vibrating plate part was 16 cm and the thickness was 0.25 mm.

Using conventional methods, the Young modulus, density, and specific modulus of elasticity of the vibrating plate part of the thus-obtained speaker member were measured. Using conventional methods, the Young modulus, density, and internal loss of the edge part were measured. Results are shown in Table 1 below along with the results of Examples 2 to 8 and Comparative examples 1 to 3 described below.

TABLE 1

| | vibrating plate part | | | edge part | | |
|---|---|---|---|---|---|---|
| | Young's modulus * 1) | density g/cm$^3$ | specific modulus of elasticity * 2) | Young's modulus * 1) | density g/cm$^3$ | internal loss tan δ |
| Example | | | | | | |
| 1 | 6.1 | 1.31 | 4.66 | 0.46 | 1.22 | 0.038 |
| 2 | 5.2 | 1.31 | 3.97 | 0.30 | 1.20 | 0.041 |
| 3 | 4.8 | 1.31 | 3.66 | 0.19 | 1.21 | 0.045 |
| 4 | 3.8 | 1.31 | 2.90 | 0.18 | 1.23 | 0.040 |
| 5 | 6.8 | 1.28 | 5.31 | 0.43 | 1.16 | 0.036 |
| 6 | 6.4 | 1.28 | 5.00 | 0.40 | 1.17 | 0.037 |
| 7 | 7.1 | 1.29 | 5.50 | 0.48 | 1.20 | 0.036 |
| 8 | 7.5 | 1.30 | 5.77 | 0.52 | 1.23 | 0.028 |
| Comparative Example | | | | | | |
| 1 | 2.0 | 0.62 | 5.77 | 1.50 | 1.15 | 0.028 |
| 2 | 4.5 | 1.25 | 5.77 | 0.073 | 1.03 | 0.041 |
| 3 | 1.1 | 4.51 | 5.77 | 11 | 4.51 | 0.002 |

* 1) $10^{10}$ dyn/cm$^2$
* 2) $10^{10}$ dyn · cm/g

EXAMPLE 2

A non-woven fabric was prepared from short fibers of rayon fiber (fiber length: 38 mm) in the same manner as in Example 1. A speaker member was obtained in the same manner as in Example 1 except that a laminated body having a urethane elastomer film disposed between the thus-obtained non-woven fabric obtained in Example 1 was prepared. The thus-obtained speaker member was evaluated in the same manner as in Example 1. Results are shown in Table 1 given above.

EXAMPLE 3

A non-woven fabric was prepared from short fibers of cotton fiber (fiber length: 38 mm) in the same manner as in Example 1. A speaker member was obtained in the same manner as in Example 1 except that a laminated body having a urethane elastomer film disposed between the thus-obtained non-woven fabric and the non-woven fabric obtained in Example 1 was prepared.

EXAMPLE 4

A non-woven fabric was prepared from short fibers of meta-aramid fiber (Cornex; made by Teijin Ltd.; fiber length: 38 mm) in the same manner as in Example 1. A speaker member was obtained in the same manner as in Example 1 except that a laminated body having a urethane elastomer film disposed between the thus-obtained two non-woven fabric sheets was prepared. The thus-obtained speaker member was evaluated in the same manner as in Example 1. Results are shown in Table 1 given above.

EXAMPLE 5

A speaker member was obtained in the same manner as in Example 1 except that an olefin elastomer film (Mirastomer 5030N; made by Mitsui Chemical Co., Ltd.; thickness: 0.05 mm) was used in place of the urethane elastomer film. The thus-obtained speaker member was evaluated in the same manner as in Example 1. Results are shown in Table 1 given above.

EXAMPLE 6

A speaker member was obtained in the same manner as in Example 1 except that a styrene elastomer film (Hybler 5127; made by Kuraray Co., Ltd.; thickness: 0.05 mm) was used in place of the urethane elastomer film. Results are shown in Table 1 given above.

EXAMPLE 7

A speaker member was obtained in the same manner as in Example 1 except that an amide elastomer film (Diamide PAE·E47-S1; made by Daicel Huls Co., Ltd.; thickness: 0.05 mm) was used in place of the urethane elastomer film. The thus-obtained speaker member was evaluated in the same manner as in Example 1. Results are shown in Table 1 given above.

EXAMPLE 8

A speaker member was obtained in the same manner as in Example 1 except that a polyester elastomer film (Hitrel 4057; made by Toray DuPont Co., Ltd.; thickness: 0.05 mm) was used in place of the urethane elastomer film. The thus-obtained speaker member was evaluated in the same manner as in Example 1. Results are shown in Table 1 given above.

COMPARATIVE EXAMPLE 1

A cone and a roll-shaped edge around the periphery of the cone was prepared from a pulp suspension by an established method using a wire cloth, and these parts were then hot pressed. Next, an acrylic resin was coated onto the edge part to form a pulp cone vibrating plate with an integral edge. This vibrating plate had a diameter of 16 cm and thickness of 0.85 mm. The thus-obtained vibrating plate was evaluated in the same manner as in Example 1. Results are shown in Table 1 given above.

COMPARATIVE EXAMPLE 2

Using two-color injection molding method, a vibrating plate part was formed from polypropylene resin (containing mica in an amount of 30% by weight) and an olefin elastomer was formed into the shape of an edge around the periphery of the vibrating part so as to obtain an integral, polypropylene cone/olefin elastomer edge vibrating plate with a diameter of 16 cm and a thickness of 0.28 mm. The thus-obtained vibrating plate was evaluated in the same manner as in Example 1. Results are shown in Table 1 given above.

COMPARATIVE EXAMPLE 3

A titanium foil of 50 $\mu$m thickness was hot pressed using matched die, having an integral shapes of a dome-shaped vibrating plate part, and a roll-shaped edge part formed around the periphery of the vibrating plate part. A dome-shaped vibrating plate with an integral roll-shaped edge of 25 mm diameter was obtained. The thus-obtained vibrating plate was evaluated in the same manner as in Example 1. Results are shown in Table 1 given above.

B. Speaker member having an integrally formed base material containing an edge part impregnated with a photocurable resin.

EXAMPLE 9

A solution containing unsaturated polyester was prepared in the same manner as in Example 1. Meanwhile, short fibers of a para-aramid fiber (Technola; made by Teijin Ltd.; fiber length: 38 mm) were oriented randomly in an air stream by the dry method to prepare an accumulated layer, and the fibers were mechanically entangled with each other by the water stream entanglement method to prepare a non-woven fabric of a weight of 35 g/m$^2$.

The above-described solution containing unsaturated polyester was selectively applied at a density of approximately 125 to 150 g/m$^2$ onto the central part (in other words, the portion is to be the vibrating plate) of the laminated body. Using matched die having shapes of a vibrating plate part with an integral edge part, hot pressing at 130° C. was performed for 1 minute to cure the resin of the vibrating plate part and simultaneously preformed the edge part.

Next, ultraviolet-curable resin was coated onto the preformed edge part at a density of approximately 90 to 100 g/m$^2$ and the ultraviolet-curable resin was cured by irradiating an ultraviolet at an irradiation density of 750 mW/cm$^2$ for 30 seconds. A cone type speaker member having the vibrating plate part with a diameter of 16 cm and a thickness of 0.23 mm was obtained.

Using conventional methods, the Young modulus, density, and specific modulus of elasticity of the vibrating plate part of the thus-obtained speaker member were measured. Also, using conventional methods, the Young modulus, density, and internal loss of the edge part were measured. Results are shown in Table 2 below along with the results of the Examples 10 to 12 described below.

TABLE 2

| | vibrating plate part | | | edge part | | |
|---|---|---|---|---|---|---|
| Example | Young's modulus * 1) | density g/cm$^3$ | specific modulus of elasticity * 2) | Young's modulus * 1) | density g/cm$^3$ | internal loss tan δ |
| 9 | 6.7 | 1.35 | 4.96 | 0.17 | 1.22 | 0.030 |
| 10 | 2.8 | 1.28 | 2.18 | 0.72 | 1.20 | 0.038 |
| 11 | 3.2 | 1.30 | 2.46 | 0.49 | 1.20 | 0.035 |
| 12 | 3.1 | 1.31 | 2.37 | 0.61 | 1.21 | 0.033 |

* 1) $10^{10}$ dyn/cm$^2$
* 2) $10^{10}$ dyn · cm/g

EXAMPLE 10

A speaker member was obtained in the same manner as in Example 9 except that rayon fibers (fiber length: 38 mm) was used in place of para-aramid fibers. The thus-obtained speaker member was evaluated in the same manner as in Example 9. Results are shown in Table 2 given above.

EXAMPLE 11

A speaker member was obtained in the same manner as in Example 9 except that cotton fibers (fiber length: 38 mm) was used in place of para-aramid fibers. The thus-obtained speaker member was evaluated in the same manner as in Example 9. Results are shown in Table 2 given above.

EXAMPLE 12

A speaker member was obtained in the same manner as in Example 9 except that meta-aramid fibers (Cornex; made by Teijin Ltd.; fiber length: 38 mm) was used in place of para-aramid fibers. The thus-obtained speaker member was evaluated in the same manner as in Example 9. Results are shown in Table 2 given above.

C. Integrally formed speaker member having non-woven fabric as the base material

EXAMPLE 13

A speaker member was obtained in the same manner as in Example 1 except that a non-woven urethane elastomer fabric (Espansione; made by Kanebo Gohsen Ltd.; weight per unit area: 200 g/m$^2$) was used in place of the laminated body used in Example 1. The vibrating plate part of this speaker member had a cone-shaped part with a diameter of 16 cm, a thickness of 0.23 mm, and a resin content of approximately 55%. The edge part had a roll-shaped part with a width of 13 mm and a thickness of 0.50 mm. The thus-obtained speaker member was evaluated in the same manner as in Example 1. Results are shown in Table 3 below along with the results of the Examples 14 to 18 described below.

TABLE 3

| | vibrating plate part | | | edge part | | |
|---|---|---|---|---|---|---|
| Example | Young's modulus * 1) | density g/cm$^3$ | specific modulus of elasticity * 2) | Young's modulus * 1) | density g/cm$^3$ | internal loss tan δ |
| 13 | 1.8 | 1.33 | 1.35 | 0.0092 | 0.95 | 0.283 |
| 14 | 3.7 | 1.27 | 2.91 | 0.0092 | 0.95 | 0.283 |
| 15 | 3.3 | 1.27 | 2.60 | 0.0092 | 0.95 | 0.283 |
| 16 | 4.8 | 1.32 | 3.64 | 0.0092 | 0.95 | 0.283 |
| 17 | 5.6 | 1.34 | 4.18 | 0.0092 | 0.95 | 0.283 |
| 18 | 3.0 | 1.22 | 2.46 | 0.0092 | 0.95 | 0.283 |

* 1) $10^{10}$ dyn/cm$^2$
* 2) $10^{10}$ dyn · cm/g

EXAMPLE 14

A speaker member was obtained in the same manner as in Example 13 except that 20 parts of para-aramid short fibers (Technola; made by Teijin Ltd.; fiber length: 6.0 mm) were further added to the solution containing unsaturated polyester. The resin content of the thus-obtained vibrating plate part of the speaker member was approximately 50%. The thus-obtained speaker member was evaluated in the same manner as in Example 1. Results are shown in Table 3 given above.

EXAMPLE 15

A speaker member was obtained in the same manner as in Example 13 except that 20 parts of polyarylate short fibers (Vectran; made by Kuraray Co., Ltd.; fiber length: 6.0 mm) were further added to the solution containing unsaturated polyester. The resin content of the thus-obtained vibrating plate part of the speaker member was approximately 50%. The thus-obtained speaker member was evaluated in the same manner as in Example 1. Results are shown in Table 3 given above.

EXAMPLE 16

A speaker member was obtained in the same manner as in Example 13 except that 20 parts of poly-para-phenylene benz-bis-oxazole (PBO) short fibers (Zylon; made by Toyobo Co. Ltd.; fiber length: 6.0 mm) were further added to the solution containing unsaturated polyester. The resin content of the vibrating plate part of the thus-obtained speaker member was approximately 50%. The thus-obtained speaker member was evaluated in the same manner as in Example 1. Results are shown in Table 3 given above.

EXAMPLE 17

A speaker member was obtained in the same manner as in Example 13 except that 20 parts of short fibers of carbon fiber (Toreka; made by Toray Co., Ltd.; fiber length: 6.0 mm) were further added to the solution containing unsaturated polyester. The resin content of the thus-obtained vibrating plate part of the speaker member was approximately 50%. The thus-obtained speaker member was evaluated in the same manner as in Example 1. Results are shown in Table 3 given above.

EXAMPLE 18

A speaker member was obtained in the same manner as in Example 13 except that 20 parts of ultra-high strength polyethylene short fibers (Dynema; made by Toyobo Co., Ltd.; fiber length: 6.0 mm) were further added to the solution containing unsaturated polyester. The resin content of the vibrating plate part of the thus-obtained speaker member was approximately 50%. The thus-obtained speaker member was evaluated in the same manner as in Example 1. Results are shown in Table 3 given above.

D. Integrally formed speaker member having elastic woven fabric as the base material

EXAMPLE 19

A speaker member was obtained in the same manner as in Example 1 except that an elastic woven fabric made of saturated polyester fibers (Corterra; made by Shell Chemical Ltd.; weight per unit area: 200 g/m$^2$) was used in place of the laminated body used in Example 1. The vibrating plate part of this speaker member had a cone-shaped part with a diameter of 16 cm, a thickness of 0.23 mm, and a resin content of approximately 55%. The edge part had a roll-shaped part with a width of 13 mm and a thickness of 0.50 mm. The thus-obtained speaker member was evaluated in the same manner as in Example 1. Results are shown in Table 4 below along with the results of Examples 20 to 25 described below.

TABLE 4

| | vibrating plate part | | | edge part | | |
|---|---|---|---|---|---|---|
| Example | Young's modulus * 1) | density g/cm$^3$ | specific modulus of elasticity * 2) | Young's modulus * 1) | density g/cm$^3$ | internal loss tan δ |
| 19 | 2.07 | 1.38 | 1.50 | 0.017 | 1.35 | 0.132 |
| 20 | 2.24 | 1.34 | 1.67 | 0.017 | 1.40 | 0.036 |

TABLE 4-continued

| | vibrating plate part | | | edge part | | |
|---|---|---|---|---|---|---|
| Example | Young's modulus * 1) | density g/cm$^3$ | specific modulus of elasticity * 2) | Young's modulus * 1) | density g/cm$^3$ | internal loss tan δ |
| 21 | 4.26 | 1.31 | 3.25 | 0.017 | 1.35 | 0.132 |
| 22 | 3.80 | 1.31 | 2.90 | 0.017 | 1.35 | 0.132 |
| 23 | 5.52 | 1.36 | 4.06 | 0.017 | 1.35 | 0.132 |
| 24 | 6.44 | 1.39 | 4.63 | 0.017 | 1.35 | 0.132 |
| 25 | 3.45 | 1.27 | 2.72 | 0.017 | 1.35 | 0.132 |

* 1) $10^{10}$ dyn/cm$^2$
* 2) $10^{10}$ dyn · cm/g

EXAMPLE 20

A speaker member was obtained in the same manner as in Example 19 except that an elastic woven fiber made of a saturated polyester (Tetron; made by Toray Co., Ltd.; weight per unit area: 200 g/m$^2$) which is different from that of Example 19. The resin content of the vibrating plate part of the thus-obtained speaker member was approximately 50%. The thus-obtained speaker member was evaluated in the same manner as in Example 1. Results are shown in Table 4 given above.

EXAMPLE 21

A speaker member was obtained in the same manner as in Example 19 except that 20 parts of para-aramid short fibers (Technola; made by Teijin Ltd.; fiber length: 6.0 mm) were further added to the solution containing unsaturated polyester. The resin content of the vibrating plate part of the thus-obtained speaker member was approximately 50%. The thus-obtained speaker member was evaluated in the same manner as in Example 1. Results are shown in Table 4 given above.

EXAMPLE 22

A speaker member was obtained in the same manner as in Example 19 except that 20 parts of polyarylate short fibers (Vectran; made by Kuraray Co., Ltd.; fiber length: 6.0 mm) were further added to the solution containing unsaturated polyester. The resin content of the vibrating plate part of the thus-obtained speaker member was approximately 50%. The thus-obtained speaker member was evaluated in the same manner as in Example 1. Results are shown in Table 4 given above.

EXAMPLE 23

A speaker member was obtained in the same manner as in Example 19 except that 20 parts of poly-para-phenylene benz-bis-oxazole (PBO) short fibers (Zylon; made by Toyobo Co., Ltd.; fiber length: 6.0 mm) were further added to the solution containing unsaturated polyester. The resin content of the vibrating plate part of the thus-obtained speaker member was approximately 50%. The thus-obtained speaker member was evaluated in the same manner as in Example 1. Results are shown in Table 4 given above.

EXAMPLE 24

A speaker member was obtained in the same manner as in Example 19 except that 20 parts of short fibers of carbon fiber (Toreka; made by Toray Co., Ltd.; fiber length: 6.0 mm) were further added to the solution containing unsaturated polyester. The resin content of the vibrating plate part of the thus-obtained speaker member was approximately 50%. The thus-obtained speaker member was evaluated in the same manner as in Example 1. Results are shown in Table 4 given above.

EXAMPLE 25

A speaker member was obtained in the same manner as in Example 19 except that 20 parts of ultra-high strength polyethylene short fibers (Dynema; made by Toyobo Co., Ltd.; fiber length: 6.0 mm) were further added to the solution of unsaturated polyester. The resin content of the thus-obtained vibrating plate part of the speaker member was approximately 50%. The thus-obtained speaker member was evaluated in the same manner as in Example 1. Results are shown in Table 4 given above.

E. Speaker member formed integrally from the same base material and having a vibrating plate and a edge part that are impregnated with different thermosetting resins

EXAMPLE 26

A solution containing unsaturated polyester was prepared in the same manner as in Example 1. Furthermore, a polyether urea elastomer solution with the following compositions was prepared:

Polyether Urea Elastomer Solution A (SX-027/A; made by Ihara Chemical Industry Co., Ltd.): 100 (parts)

Polyether Urea Elastomer Solution B (SX-027/B; made by Ihara Chemical Industry Co., Ltd.): 60.9

Meanwhile, short fibers of a para-aramid fiber (Technola; made by Teijin Ltd.; fiber length: 38 mm) were oriented randomly in an air stream by the dry method to prepare an accumulated layer. The fibers were mechanically entangled with each other by the water stream entanglement method to prepare a non-woven fabric of a weight of 60 g/m$^2$. This non-woven fabric was used as a base material.

The above-described solution containing unsaturated polyester was selectively applied at a density of approximately 125 to 150 g/m$^2$ onto the central part (in other words, the portion is to be the vibrating plate) of the laminated body, and the above-described polyether urea elastomer solution was applied at a density of approximately 60 to 120 g/m$^2$ onto the peripheral part (in other words, the portion is to be the edge). Using matched die having shapes of a vibrating plate part with an integral edge part, hot pressing at 130° C. was performed for 3 minutes and then curing was performed at 100° C. for 30 minutes to obtain a cone-shaped speaker member. The vibrating plate part of this cone-shaped speaker had a diameter of 16 cm, a thickness of 0.23 mm, and a resin content of approximately 55%, and the edge part was a roll-shaped part with a width of 13 mm and a thickness of 0.50 mm. The thus-obtained speaker member was evaluated in the same manner as in Example 1. Results are shown in Table 5 below along with the results of the Examples 27 to 30 described below.

TABLE 5

| | vibrating plate part | | | edge part | | |
|---|---|---|---|---|---|---|
| Example | Young's modulus * 1) | density g/cm$^3$ | specific modulus of elasticity * 2) | Young's modulus * 1) | density g/cm$^3$ | internal loss tan δ |
| 26 | 5.3 | 1.31 | 4.05 | 0.0534 | 1.35 | 0.098 |
| 27 | 4.1 | 1.31 | 3.13 | 0.0503 | 1.40 | 0.108 |

TABLE 5-continued

| | vibrating plate part | | | edge part | | |
|---|---|---|---|---|---|---|
| Example | Young's modulus * 1) | density g/cm$^3$ | specific modulus of elasticity * 2) | Young's modulus * 1) | density g/cm$^3$ | internal loss tan δ |
| 28 | 3.2 | 1.27 | 2.52 | 0.0486 | 1.35 | 0.112 |
| 29 | 2.8 | 1.27 | 2.20 | 0.0461 | 1.35 | 0.127 |
| 30 | 3.1 | 1.25 | 2.48 | 0.0286 | 1.35 | 0.132 |

* 1) $10^{10}$ dyn/cm$^2$
* 2) $10^{10}$ dyn · cm/g

EXAMPLE 27

A speaker member was obtained in the same manner as in Example 26 except that the base material was formed by using meta-aramid fibers (Cornex; made by Teijin Ltd.; fiber length: 38 mm), a speaker member was obtained in the same manner as in the twenty-sixth example. The thus-obtained speaker member was evaluated in the same manner as in Example 1. Results are shown in Table 5 given above.

EXAMPLE 28

A speaker member was obtained in the same manner as in Example 26 except that a non-woven rayon fiber fabric (XL-6040; made by Japan Byleen Co. Ltd.; fiber length: 38 mm; weight per unit area: 40 g/cm$^2$) was used as the base material. The thus-obtained speaker member was evaluated in the same manner as in Example 1. Results are shown in Table 5 given above.

EXAMPLE 29

A speaker member was obtained in the same manner as in Example 26 except that a non-woven cotton fiber fabric (Oicos/AP1040; made by Nisshin Spinning Co. Ltd.; fiber length: 38 mm) was used as the base material. The thus-obtained speaker member was evaluated in the same manner as in Example 1. Results are shown in Table 5 given above.

EXAMPLE 30

Short fibers of silk (fiber length: 58 mm) were boiled in slightly basic hot water and refined until the sericin content became less than 1%. A non-woven fabric was prepared from these silk fibers. This fabric was used as the base material. For the subsequent procedures, the same procedures as those of the Example 26 were used to obtain a speaker member. The thus-obtained speaker member was evaluated in the same manner as in Example 1. Results are shown in Table 5 given above.

F. Speaker member formed integrally from a base material of non-woven fabric/non-woven elastomer fabric/non-woven fabric

EXAMPLE 31

A solution containing unsaturated polyester was prepared in the same manner as in Example 1. Meanwhile, short fibers of a para-aramid fiber (Technola; made by Teijin Ltd.; fiber length: 38 mm) were oriented randomly in an air stream by the dry method to prepare an accumulated layer. The fibers were mechanically entangled with each other by the water stream entanglement method to prepare a non-woven fabric of a weight of 35 g/m$^2$. A laminated body, in which a non-woven urethane elastomer fabric (Espansione·ES25A; made by Kanebo Gohsen Ltd.; weight per unit area: 25 g/m$^2$) was disposed between the thus-obtained two non-woven fabric sheets, was prepared.

The above-described solution containing unsaturated polyester was selectively applied at a density of approximately 125 to 150 g/m$^2$ onto the central part (in other words, the portion is to be the vibrating plate) of the laminated body, and using matched die having the shapes of a vibrating plate part with an integral edge part, hot pressing at 130° C. was performed for 1 minute to obtain a cone type speaker with a diameter of 16 cm and a thickness of 0.23 mm.

Using conventional methods, the Young modulus, density, and specific modulus of elasticity of the vibrating plate part of the thus-obtained speaker member were measured, and using conventional methods, the Young modulus, density, and internal loss of the edge part were measured. Results are shown in Table 6 below along with the results of Examples 32 to 34 described below.

TABLE 6

| | vibrating plate part | | | edge part | | |
|---|---|---|---|---|---|---|
| Example | Young's modulus * 1) | density g/cm$^3$ | specific modulus of elasticity * 2) | Young's modulus * 1) | density g/cm$^3$ | internal loss tan δ |
| 31 | 6.5 | 1.29 | 5.04 | 0.49 | 1.20 | 0.036 |
| 32 | 5.7 | 1.29 | 4.42 | 0.33 | 1.20 | 0.039 |
| 33 | 5.5 | 1.29 | 4.26 | 0.22 | 1.20 | 0.043 |
| 34 | 4.4 | 1.29 | 3.41 | 0.20 | 1.20 | 0.038 |

* 1) $10^{10}$ dyn/cm$^2$
* 2) $10^{10}$ dyn · cm/g

EXAMPLE 32

A non-woven fabric was formed from short fibers of rayon fiber (fiber length: 38 mm) in the same manner as in the Example 31. A laminated body, in which the same non-woven urethane elastomer fabric obtained in Example 31 was disposed between the thus-obtained non-woven fabric and the non-woven para-aramid fabric obtained in Example 31, was prepared. For the subsequent procedures, the same procedures in Example 31 were used to obtain a speaker member. The thus-obtained speaker member was evaluated in the same manner as in Example 31. Results are shown in Table 6 given above.

EXAMPLE 33

A non-woven fabric was formed from short fibers of cotton fiber (fiber length: 38 mm) in the same manner as in Example 31. A laminated body, in which non-woven urethane elastomer fabric obtained in Example 31 was disposed between the thus-obtained non-woven fabric and the non-woven para-aramid fabric obtained in Example 31, was prepared. For the subsequent procedures, the same procedures as those of Example 31 were used to obtain a speaker member. The thus-obtained speaker member was evaluated in the same manner as in Example 31. Results are shown in Table 6 given above.

EXAMPLE 34

A non-woven fabric was formed from short fibers of meta-aramid fiber (Cornex; made by Teijin Ltd.; fiber length: 38 mm) in the same manner as in Example 31. A laminated body, in which the non-woven urethane elastomer obtained in Example 31 was disposed between the thus-obtained two non-woven fabric sheets, was prepared. For subsequent procedures, the same procedures in Example 31 were used to obtain a speaker member. The thus-obtained speaker was evaluated in the same manner as in Example 31. Results are shown in Table 6 given above.

G. Speaker member formed integrally from a base material of non-woven fabric/elastic woven fabric/non-woven fabric

EXAMPLE 35

A solution containing unsaturated polyester was prepared in the same manner as in Example 1. Meanwhile, short fibers of a para-aramid fiber (Technola; made by Teijin Ltd.; fiber length: 38 mm) were oriented randomly in an air stream by the dry method to prepare an accumulated layer, and the fibers were mechanically entangled with each other by the water stream entanglement method to prepare a non-woven fabric of a weight of 35 g/m$^2$. Using two sheets of the thus-obtained non-woven fabric, a laminated body was prepared having an elastic woven fabric (weight per unit area: 25 g/m$^2$) of saturated polyester fiber (Cortterra; made by Shell Chemical Ltd.) disposed between the non-woven fabric sheets.

The above-described solution containing unsaturated polyester was selectively applied at a density of approximately 125 to 150 g/m$^2$ onto the central part (in other words, the portion is to be the vibrating plate) of the laminated body, and using matched die having the shapes of a vibrating plate part with an integral edge part, hot pressing at 130° C. was performed for 1 minute to obtain a cone type speaker with a diameter of 16 cm and a thickness of 0.20 mm.

Using conventional methods, the Young modulus, density, and specific modulus of elasticity of the vibrating plate part of the thus-obtained speaker member were measured. Also, using conventional methods, the Young modulus, density, and internal loss of the edge part were measured. Results are shown in Table 7 below along with the results of Examples 36 to 38 described below.

TABLE 7

| | vibrating plate part | | | edge part | | |
|---|---|---|---|---|---|---|
| Example | Young's modulus * 1) | density g/cm$^3$ | specific modulus of elasticity * 2) | Young's modulus * 1) | density g/cm$^3$ | internal loss tan δ |
| 35 | 6.8 | 1.32 | 5.15 | 0.50 | 1.23 | 0.035 |
| 36 | 6.0 | 1.32 | 4.55 | 0.36 | 1.22 | 0.037 |
| 37 | 5.8 | 1.32 | 4.39 | 0.25 | 1.22 | 0.041 |
| 38 | 4.6 | 1.32 | 3.48 | 0.22 | 1.22 | 0.036 |

* 1) $10^{10}$ dyn/cm$^2$
* 2) $10^{10}$ dyn · cm/g

EXAMPLE 36

A woven fabric was formed from short fibers of rayon fiber (fiber length: 38 mm) in the same manner as in Example 35. A laminated body, in which the elastic woven fabric of saturated polyester fiber obtained in Example 35 was disposed between the thus-obtained non-woven fabric and the non-woven fabric obtained in Example 35, was prepared. For the subsequent procedures, the same procedures as those of Example 35 were used to obtain a speaker member. The thus-obtained speaker member was evaluated in the same manner as in Example 35. Results are shown in Table 7 given above.

EXAMPLE 37

A non-woven fabric was formed from short fibers of cotton fiber (fiber length: 38 mm) in the same manner as in Example 35. A laminated body, in which the elastic woven fabric of saturated polyester fiber obtained in Example 35 was disposed between the thus-obtained non-woven fabric and the non-woven fabric obtained in Example 35, was prepared. For the subsequent procedures, the same procedures as those of Example 35 were used to obtain a speaker member. The thus-obtained speaker member was evaluated in the same manner as in Example 35. Results are shown in Table 7 given above.

EXAMPLE 38

A non-woven fabric was formed from short fibers of meta-aramid fiber (Cornex; made by Teijin Ltd.; fiber length: 38 mm) in the same manner as in Example 35. A laminated body, in which the elastic woven fabric of saturated polyester fibers obtained in Example 35 was disposed between the thus-obtained two non-woven fabric sheets, was prepared. For the subsequent procedures, the same procedures as those of Example 35 were used to obtain a speaker member. The thus-obtained speaker member was evaluated in the same manner as in Example 35. Results are shown in Table 7 given above.

H. Flat speaker member having a flat vibrating plate part and an edge part formed integrally from the same base material

EXAMPLE 39

A containing unsaturated polyester solution of the following composition was prepared:

Unsaturated polyester resin (N350L; made by Nihon Shokubai Co., Ltd.): 100 (parts)

Graphite (CSPE; made by Japan Graphite Co., Ltd.): 20

Low schrink agent (Modiper S501; made by NOF corporation): 5

Per-octa O (made by NOF corporation): 3

Meanwhile, short fibers of a para-aramid fiber (Technola; made by Teijin Ltd.; fiber length: 38 mm) were oriented randomly in an air stream by the dry method to prepare an accumulated layer, and the fibers were mechanically entangled with each other by the water stream entanglement method to prepare a non-woven fabric of a weight of 60 g/m$^2$. A laminated body, in which a polyurethane elastomer film (Elastolan·NY Type; made by Takeda Badesch Urethane Industry Co., Ltd.; thickness: 0.07 mm) was disposed between the thus-obtained two non-woven fabric sheets.

Figure 4:
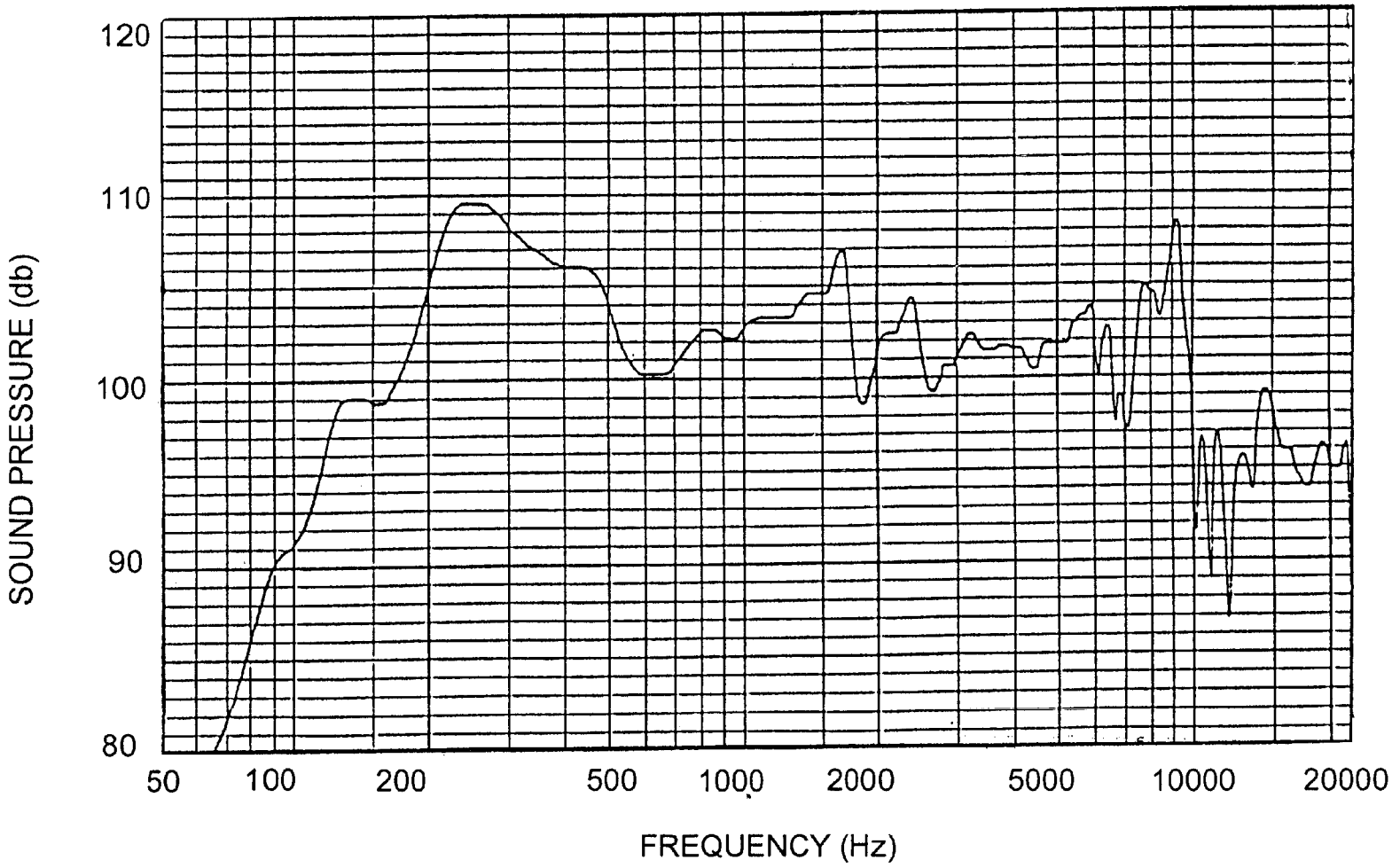
FIG. 4 is a graph showing the relationship between frequency and sound pressure of a flat speaker member according to the preferred embodiment of the present invention.

The above-described solution containing unsaturated polyester was selectively coated (coating amount: 2.22 to 2.49 g) onto the central part (in other words, the portion to be the vibrating plate) of the laminated body. Using matched die having the shapes of a flat vibrating plate part with a reinforcing part and an integral edge part, hot pressing at 130° C. was performed for 1 minute to obtain a speaker with a flat vibrating plate part and an edge part. The vibrating plate part had dimensions of 62 mm×10 mm and a thickness of 0.2 mm. Using conventional methods, the frequency—sound pressure characteristics of the thus-obtained speaker member was measured. Results are shown in FIG. 4. In FIG. 4, the x-axis indicates the frequency (Hz) in logarithmic scale and the y-axis indicates the sound pressure (dB).

COMPARATIVE EXAMPLE 4

Figure 5:
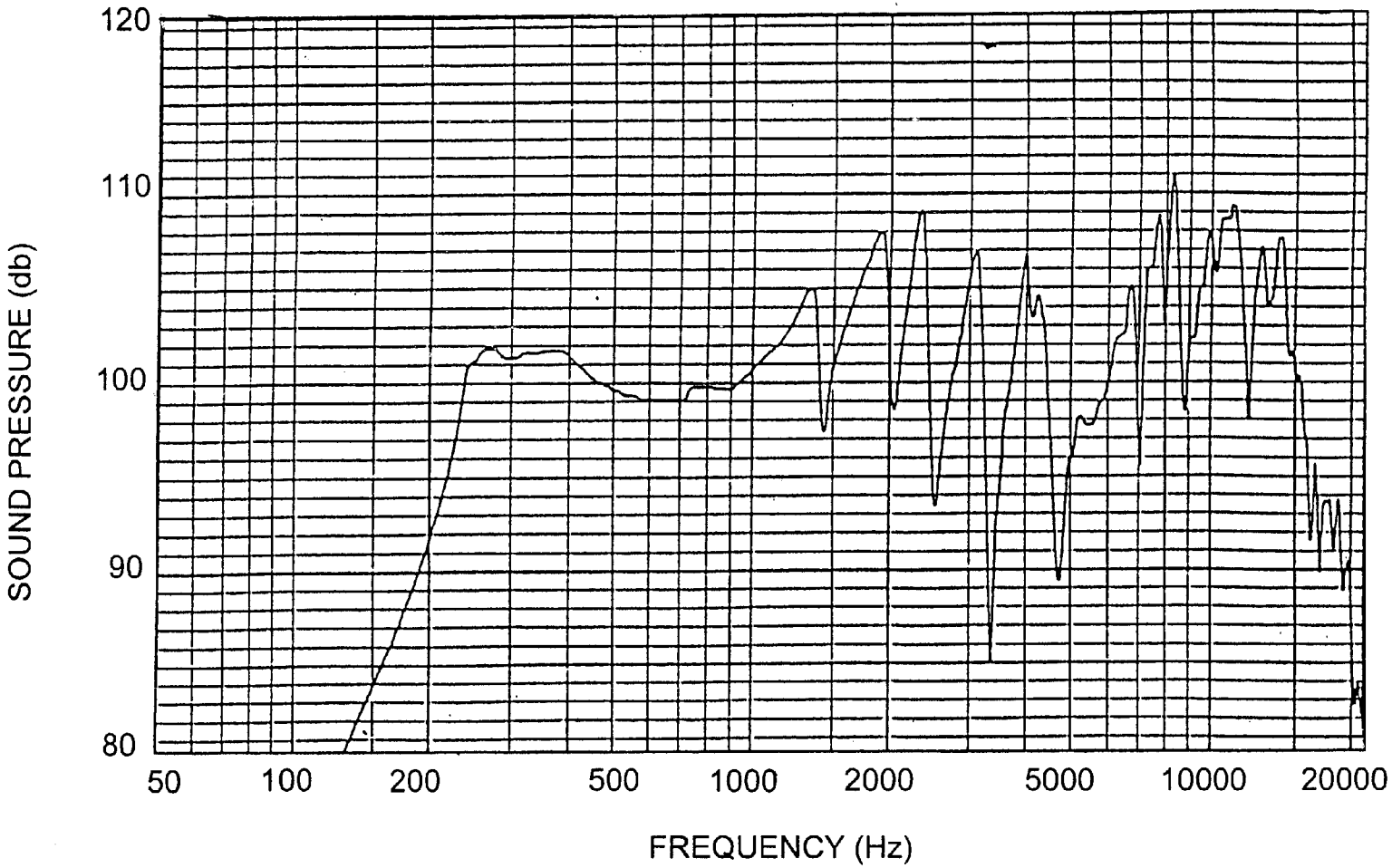
FIG. 5 is a graph showing the relationship between frequency and sound pressure of a conventional flat speaker.

A speaker member having a flat vibrating plate part and an edge part was assembled by adhering together a vibrating plate (dimensions: 62 mm×100 mm, thickness: 3 mm) made from foaming material (modified PPO (polyphenylene oxide)) and an edge made from polyurethane elastomer (thickness: 0.07 mm). The thus-obtained speaker member was evaluated in the same manner as in Example 39. Results are shown in FIG. 5.

As is clear from Example 39 and Comparative example 4, since the method for manufacturing a flat speaker member of the present invention simultaneously forms the flat vibrating plate part and the edge part using the same material (non-woven fabric), the method is low in cost and excellent in low level of material loss. Also, since the flat vibrating plate in Example 39 is higher in strength than that of Comparative example 4, the vibrating plate of the present invention can be made extremely thin. The thickness of the vibrating plate in Example 39 is 0.2 mm; whereas the vibrating plate in comparative example 4 is 3 mm, that is, the thickness of the vibrating plate of the present invention can be less than 1/10 of the conventional vibration plate. Furthermore, as is clear from FIG. 4 and FIG. 5, the peak-dip difference in the medium to high range of the flat speaker member in Example 39 (FIG. 4) is reduced significantly in comparison to the flat speaker of the Comparative example 5 (FIG. 5).

As is clear from the above descriptions in Example 1 to 39 since the manufacturing method of the present invention simultaneously forms the vibrating plate part and the edge part by using the same material (laminated body base material, woven fabric base material, or non-woven fabric base material), the material loss is low and the number of manufacturing processes can be reduced. The method is thus low in cost and excellent in manufacturing efficiency.

Also, as is clear from Tables 1 to 7, although the vibrating plate part and the edge part of speaker member of the present invention is formed from the same material, the vibrating plate part has excellent strength while the edge part is flexible and excellent in internal loss. According to the present invention, a vibrating plate and an edge are simultaneously formed with the same material, and retaining each conflicting characteristics, can be formed. Thus, a problem that could not be solved for a long time can be solved.

As has been described above, according to the present invention, by selectively coating a prescribed thermosetting resin onto the portion of the base material that is to be the vibrating plate part, the vibrating plate part and the edge part can be formed using the same material. Each of the vibrating plate part and the edge part of the speaker member of the present invention has its required characteristics. Furthermore, according to the present invention, a manufacturing method can be obtained that is low in cost and excellent in manufacturing efficiency.

The speaker vibrating plate of the present invention may be applied to any speaker (for example, speakers for low sound, intermediate sound, or high sound) and may also be used as a full bandwidth (full range) speaker.

Various modifications will be obvious and may be realized readily by those skilled in the art without deviating from the scope and spirit of the present invention. The scope of the attached claims is, therefore, not intended to be limited to the description of this specification but should be interpreted widely.

What is claimed is:

1. A speaker member comprising:

a vibrating plate part comprising a base material, a part of the base material being impregnated with a thermosetting resin; and an edge part containing the same base material as that of the vibrating plate part, wherein said base material is a non-woven fabric made of at least one selected from the group consisting of para-aramid fiber, meta-aramid fiber ultra-high strength polyethylene fiber, and polyarylate fiber.

2. A speaker member comprising:

a vibrating plate part comprising a base material, a part of the base material being impregnated with a thermosetting resin; and an edge part containing the same base material as that of the vibrating plate part, wherein said base material is a laminated body having at least two non-woven fabric layers and a resin film layer disposed between said non-woven fabric layers, wherein said non-woven fabric layer comprises a non-woven fabric layer made of at least one selected from the group consisting of para-aramid fiber, meta-aramid fiber, ultra-high strength polyethylene fiber, and polyarylate fiber.

3. A speaker member as set forth in claim 2, wherein said resin film layer comprises a thermoplastic elastomer.

4. A speaker member as set forth in claim 3, wherein said thermoplastic elastomer is selected from the group consisting of urethane elastomers, amide elastomers, olefin elastomers, styrene elastomers, polyester elastomers, and ethylene/vinyl acetate elastomers.

5. A speaker member comprising:

a vibrating plate part comprising a base material, a part of the base material being impregnated with a thermosetting resin; and an edge part containing the same base material as that of the vibrating plate part, wherein said base material is a laminated body having at least two first non-woven fabric layers and a second non-woven fabric layer disposed between said non-woven fabric layers.

6. A speaker member as set forth in claim 5, wherein said second non-woven fabric layer is made of thermoplastic elastomer fiber.

7. A speaker member as set forth in claim 6, wherein said thermoplastic elastomer fiber is selected from the group consisting of urethane elastomer fibers, amide elastomer fibers, olefin elastomer fibers, styrene elastomer fibers, polyester elastomer fibers, and ethylene/vinyl acetate elastomer fibers.

8. A speaker member comprising:

a vibrating plate part comprising a base material, a part of the base material being impregnated with a thermosetting resin; and an edge part containing the same base material as that of the vibrating plate part, wherein said base material is a laminated body having at least two non-woven fabric layers and an elastic woven fabric layer disposed between said non-woven fabric layers.

9. A speaker member as set forth in claim 8, wherein said elastic woven fabric layer is made of saturated polyester fiber.

10. A speaker member as set forth in claim 9, wherein said saturated polyester fiber is a poly (trimethyleneterephthalate) fiber.

11. A speaker member comprising:

a vibrating plate part comprising a base material, a part of the base material being impregnated with a thermosetting resin; and an edge part containing the same base material as that of the vibrating plate part, wherein said base material is an elastic woven fabric made of poly (trimethyleneterephthalate) fiber.

12. A speaker member comprising:

a vibrating plate part comprising a base material, a part of the base material being impregnated with a thermosetting resin; and an edge part containing the same base material as that of the vibrating plate part, wherein said edge part contains a base material impregnated with a photocurable resin or a thermosetting resin that is different from the thermosetting resin in said vibrating plate part.

13. A speaker member as set forth in claim 12, wherein said photocurable resin is an acrylic resin.

14. A speaker member as set forth in claim 12, wherein said thermosetting resin contained in the edge part is a thermosetting polyether urea elastomer.

15. A method of manufacturing a speaker member comprising:

forming a base material, impregnating a portion of the base material with a thermosetting resin wherein the portion is to be a vibrating plate part, and curing said impregnated thermosetting resin so as to form the vibrating plate part, and simultaneously forming an edge part, wherein said base material is a non-woven fabric made of at least one selected from the group consisting of para-aramid fiber, meta-aramid fiber, ultra-high strength polyethylene fiber, and polyarylate fiber, and wherein the vibrating plate part if formed by curing said impregnated thermosetting resin and the edge part is simultaneously formed by melting and solidifying said base material.

16. A method of manufacturing a speaker member comprising:

forming a base material, impregnating a portion of the base material with a thermosetting resin wherein the portion is to be a vibrating plate part, and curing said impregnated thermosetting resin so as to from the vibrating plate part, and simultaneously forming an edge part, wherein said base material is a laminated body having at least two non-woven fabric layers and a resin film layer disposed between said non-woven fabric layers, wherein said non-woven fabric layer includes a non-woven fabric layer made of at least one selected from the group consisting of para-aramid fiber, meta-aramid fiber, ultra-high strength polyethylene fiber, and polyarylate fiber, and wherein the vibrating plate part is formed by curing said impregnated thermosetting resin and the edge part is simultaneously formed by melting and solidifying said resin film layer.

17. A method of manufacturing a speaker member comprising:

forming a base material, impregnating a portion of the base material with a thermosetting resin wherein the portion is to be a vibrating plate part, and curing said impregnated thermosetting resin so as to form the vibrating plate part, and simultaneously forming an edge part, wherein said base material is a laminated body having at least two first non-woven fabric layers and a second non-woven fabric layer disposed between said first non-woven fabric layers, and wherein the vibrating plate part is formed by curing said impregnated thermosetting resin and the edge part is simultaneously formed by melting and solidifying said second non-woven fabric layer.

18. A method of manufacturing a speaker member comprising:

forming a base material, impregnating a portion of the base material with a thermosetting resin wherein the portion is to be a vibrating plate part, and curing said impregnated thermosetting resin so as to form the vibrating plate part, and simultaneously forming an edge part, wherein said base material is a laminated body having at least two non-woven fabric layers and an elastic woven fabric layer disposed between said non-woven fabric layers, and wherein the vibrating plate part is formed by curing said impregnated thermosetting resin and the edge part is simultaneously formed by melting and solidifying said elastic woven fabric layer.

19. A method of manufacturing a speaker member comprising:

forming a base material, impregnating a portion of the base material with a thermosetting resin wherein the portion is to be a vibrating plate part, and curing said impregnated thermosetting resin so as to form the vibrating plate part, and simultaneously forming an edge part, wherein said base material is an elastic woven fabric made of poly (trimethyleneterephthalate) fiber, and wherein the vibrating plate part is formed by curing said impregnated thermosetting resin and the edge part is simultaneously formed by melting and solidifying said base material.

20. A method of manufacturing a speaker member comprising:

forming a base material, impregnating a portion of the base material with a thermosetting resin wherein the portion is to be a vibrating plate part, impregnating a portion of the base material with a photocurable resin wherein the portion is to be a edge part, forming the vibrating plate part by curing said impregnated thermosetting resin, and forming the edge part by curing said impregnated photocurable resin.

21. A method of manufacturing a speaker member comprising:

forming a base material, impregnating a portion of the base material with a first thermosetting resin wherein the portion is to be a vibrating plate part, impregnating a portion of the base material with a second thermosetting resin wherein the portion is to be a edge part, and curing said impregnated first and second thermosetting resin, resulting in a simultaneous formation of the vibrating plate part at the edge part.

* * * * *